US008736493B2

(12) United States Patent
Ai et al.

(10) Patent No.: US 8,736,493 B2
(45) Date of Patent: May 27, 2014

(54) ANTENNA AND BASE STATION

(75) Inventors: Ming Ai, Shenzhen (CN); Yingtao Luo, Shenzhen (CN); Weihong Xiao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/619,301

(22) Filed: Sep. 14, 2012

(65) Prior Publication Data

US 2013/0278461 A1 Oct. 24, 2013

Related U.S. Application Data

(63) Continuation of application No. 13/592,145, filed on Aug. 22, 2012, which is a continuation of application No. PCT/CN2012/074435, filed on Apr. 20, 2012.

(51) Int. Cl.
*H01Q 3/40* (2006.01)

(52) U.S. Cl.
USPC ..... 342/373

(58) Field of Classification Search
USPC ..... 342/373; 455/562.1
IPC ..... H01Q 3/40; H04Q 7/3615; H04W 16/28
See application file for complete search history.

(56) References Cited

U.S. PATENT DOCUMENTS

| | | | | |
|---|---|---|---|---|
| 4,882,587 | A * | 11/1989 | Vodopia | 342/372 |
| 5,144,322 | A * | 9/1992 | Gabriel | 342/373 |
| 5,237,336 | A * | 8/1993 | Jelloul | 343/799 |
| 6,847,328 | B1 | 1/2005 | Libonati et al. | |
| 2004/0140864 | A1* | 7/2004 | Chen et al. | 333/126 |
| 2005/0012665 | A1 | 1/2005 | Runyon et al. | |
| 2006/0084474 | A1* | 4/2006 | Iacono et al. | 455/562.1 |
| 2007/0001897 | A1* | 1/2007 | Alland | 342/158 |

(Continued)

FOREIGN PATENT DOCUMENTS

| | | | |
|---|---|---|---|
| CN | 1868089 | A | 11/2006 |
| CN | 101076923 | A | 11/2007 |

(Continued)

OTHER PUBLICATIONS

Butler matrix. (2006). In Collins Dictionary of Astronomy. Retrieved from http://www.credoreference.com/entry/collinsastron/butler_matrix.*

(Continued)

*Primary Examiner* — Jack W Keith
*Assistant Examiner* — Fred H Mull
(74) *Attorney, Agent, or Firm* — Brinks Gilson & Lione

(57) ABSTRACT

The present invention provides an antenna and a base station. The antenna includes an antenna array and a first BUTLER network. The antenna array includes multiple radiating elements arranged vertically. The first BUTLER network includes n input ports and m output ports, the m output ports are respectively connected to at least one radiating element of the antenna array; the n input ports of the BUTLER network respectively receive a path of signals, and after phase adjustment and amplitude adjustment by the first BUTLER network, output signals of n groups of phase distribution combination through the m output ports, each group of phase distribution combination includes m phases, each output port respectively outputs signals of one phase in each group of phase distribution combination, the multiple radiating elements connected to the m output ports radiate n beams, where the n beams are distributed at specific angles on the vertical plane.

2 Claims, 11 Drawing Sheets

(56) References Cited

U.S. PATENT DOCUMENTS

| | | | | |
|---|---|---|---|---|
| 2008/0119149 | A1* | 5/2008 | Ll et al. | 455/187.1 |
| 2008/0167077 | A1* | 7/2008 | Raffaelli et al. | 455/562.1 |
| 2009/0040107 | A1* | 2/2009 | Yun et al. | 342/375 |
| 2009/0058725 | A1 | 3/2009 | Barker et al. | |
| 2009/0289864 | A1 | 11/2009 | Derneryd et al. | |
| 2012/0264469 | A1 | 10/2012 | Dartois et al. | |

FOREIGN PATENT DOCUMENTS

| | | | |
|---|---|---|---|
| CN | 101848471 | A | 9/2010 |
| JP | 59044105 | A | 3/1984 |
| WO | 2010/059186 | A2 | 5/2010 |
| WO | WO 2010059186 | A2 | 5/2010 |
| WO | WO 2010059186 | A3 | 5/2010 |

OTHER PUBLICATIONS

J. De Los Santos, MEMS-Based Microwave Circuits and Systems, Introduction to Microelectromechanical (MEM) Microwave Systems, Artech House, p. 159-195, 1999.*

International Search Report issued in corresponding PCT Patent Application No. PCT/CN2012/074435, mailed Jan. 24, 2013.

Office Action issued in commonly owned U.S. Appl. No. 13/592,145, mailed Jan. 15, 2013.

Office Action issued in commonly owned U.S. Appl. No. 13/592,145, mailed Jun. 25, 2013, 23 pages.

Active Antenna Systems: A step-change in base station site performance, Nokia Siemens White Paper, Jan. 2012, 12 pages.

"What base station antenna configuration is best for LTE-Advanced?" Commscope White Paper, Sep. 2012, 22 pages.

* cited by examiner

ANTENNA AND BASE STATION

CROSS-REFERENCE TO RELATED APPLICATIONS

This application is a continuation of U.S. patent application Ser. No. 13/592,145, filed on Aug. 22, 2012, which is a continuation of International Application No. PCT/CN2012/074435, filed on Apr. 20, 2012, which is hereby incorporated by reference in its entirety.

FIELD OF THE DISCLOSURE

The present invention relates to antenna technologies, and in particular, to an antenna and a base station.

BACKGROUND

The development of mobile communication technologies requires improvement in a base station antenna array to increase the system capacity and optimize patterns, thereby meeting the communication requirements. Generally, for example, the system capacity is increased through increasing the number of sectors implemented by increasing the number of antennas.

At present, horizontal plane splitting is implemented on an antenna to increase the system capacity.

When the horizontal plane splitting is implemented on an antenna, that is, when the base station antenna is a split antenna, generally, the multi-beam split antenna is implemented in the form of horizontal Butler network & multi-column cell array, so as to increase the system capacity.

At present, no solution is available for implementing vertical splitting on a conventional antenna.

SUMMARY OF THE DISCLOSURE

Embodiments of the present invention provide an antenna and a base station for implementing splitting of beams on a vertical plane on the antenna.

In one aspect, an embodiment of the present invention provides an antenna, including an antenna array and a first BUTLER network, where the antenna array includes multiple radiating elements arranged vertically;

the first BUTLER network has n input ports and m output ports, where m and n are natural numbers, n is greater than or equal to 2, m is greater than or equal to 3, and m is greater than n;

the m output ports are respectively connected to at least one radiating element of the antenna array, and the radiating elements connected to the m output ports in the antenna array are arranged on a vertical plane; and the n input ports of the first BUTLER network respectively receive a path of signals, the n input ports receive n paths of signals and, after phase adjustment and amplitude adjustment by the first BUTLER network, output signals of n groups of phase distribution combination through the m output ports, each group of phase distribution combination includes m phases, each output port respectively outputs signals of one phase in each group of phase distribution combination, and the multiple radiating elements connected to the m output ports radiate n beams, where the n beams are distributed at specific angles on the vertical plane.

In another aspect, an embodiment of the present invention provides a base station, which includes a pole and the foregoing antenna, where the antenna is fixed on the pole.

The antenna and base station provided by embodiments of the present invention, by using the first BUTLER network and the radiating elements arranged on a vertical plane connected to the first BUTLER network, implement the splitting of beams on the vertical plane.

DETAILED DESCRIPTION OF THE EMBODIMENTS

Figure 1A:
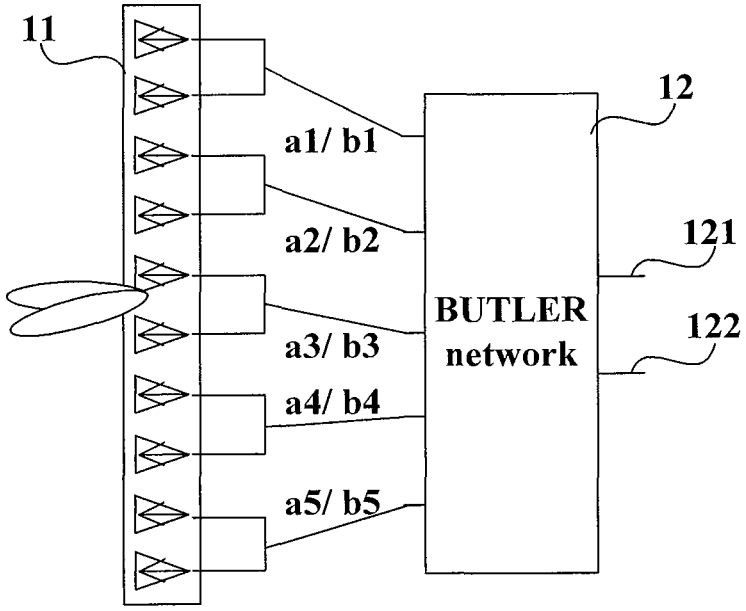
FIG. 1A is a schematic diagram of an antenna according to Embodiment 1 of the present invention.

The antenna provided in an embodiment of the present invention includes an antenna array and a first BUTLER network.

The antenna array includes multiple radiating elements arranged vertically. For example, the antenna array includes at least one column of multiple radiating elements arranged vertically.

The first BUTLER network has n input ports and m output ports, where m and n are natural numbers, n is greater than or equal to 2, m is greater than or equal to 3, and m is greater than n. The input ports are ports for connecting the first BUTLER network to a base station and implementing signal interaction with the base station; the output ports are ports for connecting the first BUTLER network to the antenna array and implementing signal interaction with the antenna array.

The m output ports are respectively connected to at least one radiating element of the antenna array, and the radiating elements connected to the m output ports in the antenna array are arranged on a vertical plane.

The n input ports of the first BUTLER network respectively receive a path of signals, the n input ports receive n paths of signals and, after phase adjustment and amplitude adjustment by the first BUTLER network, output signals of n groups of phase distribution combination through the m output ports, each group of phase distribution combination includes m phases, each output port respectively outputs signals of one phase in each group of phase distribution combination, the multiple radiating elements connected to the m output ports radiate n beams, where the n beams are distributed at specific angles on the vertical plane. In other words, after the n paths of signals enter the first BUTLER network respectively through an input port, their phases and amplitudes are adjusted by the first BUTLER network, and m×n paths of signals in total are output through the m output ports. For each path of signals input through the input ports, m paths of signals are output through the m output ports, where the phases of the m paths of signals are specifically distributed, which will be described in details in the following embodiments.

Optionally, n is equal to 2 or 3, and m is equal to 5.

The first BUTLER network includes a first power divider, a second power divider, a 90-degree hybrid coupler, a first 180-degree hybrid coupler, and a second 180-degree hybrid coupler.

An input port of the first power divider is connected to an input port of the first BUTLER network.

An output port of the first power divider is connected to a Σ input port of the first 180-degree hybrid coupler, and another output port is connected to a Σ input port of the second 180-degree hybrid coupler.

An output port of the 90-degree hybrid coupler is connected to a Δ input port of the first 180-degree hybrid coupler, and another output port is connected to a Δ input port of the second 180-degree hybrid coupler.

An output port of the first 180-degree hybrid coupler is connected to an input port of the second power divider, and another output port is connected to one of the output ports.

Two output ports of the second 180-degree hybrid coupler are respectively connected to one of the output ports.

Two output ports of the second power divider are respectively connected to one of the output ports.

When n is equal to 2, an input port of the 90-degree hybrid coupler is connected to another input port of the first BUTLER network.

When n is equal to 3, two input ports of the 90-degree hybrid coupler are respectively connected to another two input ports of the first BUTLER network.

Optionally, n is equal to 2, and m is equal to 4.

The first BUTLER network may include a third power divider, a fourth power divider, a first inverter, a second inverter, a first 90-degree hybrid coupler, and a second 90-degree hybrid coupler.

Input ports of the third power divider and the fourth power divider are respectively connected to an input port of the first BUTLER network.

An output port of the third power divider is connected to a first input port of the first 90-degree hybrid coupler, and another output port is connected to an input port of the first inverter.

An output port of the fourth power divider is connected to a second input port of the first 90-degree hybrid coupler, and another output port is connected to an input port of the second inverter.

An output port of the first inverter is connected to a first input port of the second 90-degree hybrid coupler.

An output port of the second inverter is connected to a second input port of the second 90-degree hybrid coupler.

Two output ports of the first 90-degree hybrid coupler are respectively connected to one of the output ports.

Two output ports of the second 90-degree hybrid coupler are respectively connected to one of the output ports.

Or the first BUTLER network may include a 90-degree hybrid coupler, where two input ports of the 90-degree hybrid coupler are respectively connected to an input port of the first BUTLER network, and two output ports are respectively connected to two output ports of the first BUTLER network.

Optionally, output ports of the first BUTLER network are respectively connected to two, three, or four radiating elements of the antenna array, or respectively connected to two, three, or four radiating elements in the antenna array by using a phase shifter. The phase shifter is added between a matrix network and the radiating elements so that vertical beams are capable of changing dynamically.

Optionally, there are multiple first BUTLER networks, the antenna array has multiple columns of multiple radiating elements arranged vertically corresponding to the first BUTLER networks, and the first BUTLER networks are respectively connected to the multiple radiating elements arranged vertically of the corresponding column.

Optionally, the antenna further includes multiple phase shifters having the number the same as the number of the first BUTLER networks, where the multiple phase shifters are m-in-m-out phase shifters, and the output ports of the first BUTLER networks are connected to input ports of the phase shifters.

Each output port of the phase shifters is connected to at least one radiating element of the antenna array.

Optionally, the antenna further includes m second BUTLER networks, where the m second BUTLER networks are horizontal BUTLER networks, and the numbers of input ports of the m second BUTLER networks are equal to P, where P is the number of first BUTLER networks.

Input ports of the second BUTLER networks are connected to the output ports of the first BUTLER networks, and output ports of each second BUTLER network are connected to at least two rows of parallel radiating elements in the antenna array, so that in the antenna array, the radiating elements connected to the second BUTLER networks generate P beams on the horizontal plane.

Optionally, the antenna further includes multiple phase shifters having the number the same as the number of the first BUTLER networks, where the multiple phase shifters are m-in-m-out phase shifters, the output ports of the first BUTLER networks are connected to input ports of the phase shifters, each output port of the phase shifters is connected to the input ports of the second BUTLER networks, and output ports of each second BUTLER network are connected to at least two rows of parallel radiating elements in the antenna array.

Optionally, the radiating elements are single dipole elements, orthogonal dual-polarized dipole elements, patch radiating elements, or circular radiating elements.

Optionally, the first BUTLER networks are connected to the antenna array by using a filter.

Optionally, the phase shifters are connected to the antenna array by using a filter.

Optionally, the second BUTLER networks are connected to the antenna array by using a filter.

The base station provided by embodiments of the present invention includes a pole and any one of the forgoing antennas, where the antenna is fixed on the pole.

The following further describes the antenna and the base station in detail by referring to Embodiment 1 to Embodiment 14.

Embodiment 1

As shown in FIG. 1A, an antenna includes an antenna array 11 and a BUTLER network 12. The antenna array 11 includes 10 radiating elements arranged on a vertical plane. The BUTLER network 12 is a 2-in-5-out matrix network, that is, there are two input ports: a first input port 121 and a second input port 122. Each output port of the BUTLER network 12 is connected to two radiating elements in the antenna array 11 by using a power divider (not shown in the figure, the same below). The 10 radiating elements connected to the BUTLER network 12 in the antenna array 11 are arranged on a vertical plane.

A first path of signals which are input through the first input port 121 goes through the BUTLER network 12, generates a group of signals whose phases are a1:a2:a3:a4:a5 at five output ports and, after being transmitted by the radiating elements of the antenna array 11, splits and generates an upward beam (U_beam) bearing the first path of signals on the vertical plane, as shown by the horizontal ellipse on the left side of the radiating elements in FIG. 1A.

Figure 1B:
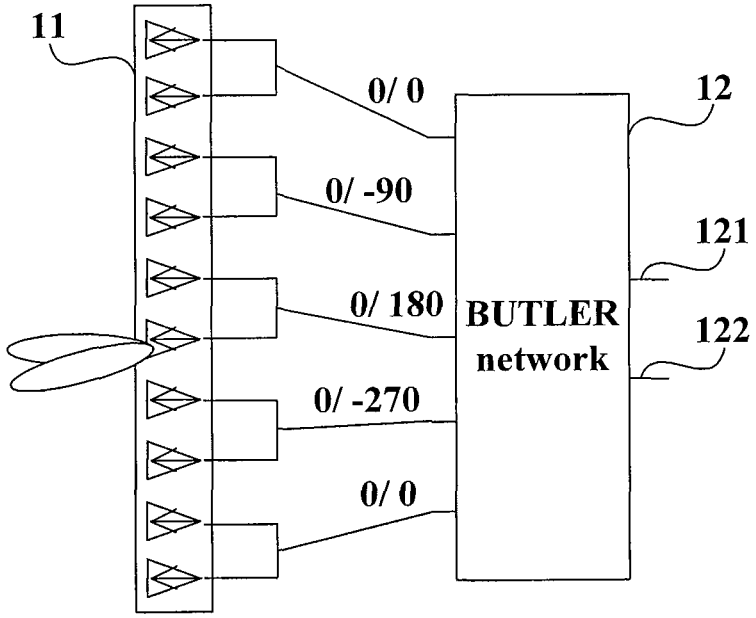
FIG. 1B is a schematic diagram of another antenna according to Embodiment 1 of the present invention.

The phases of the five ports corresponding to the U_beam are, for example, a1:a2:a3:a4:a5=0:0:0:0:0, as shown in FIG. 1B.

A second path of signals which are input through the second input port 122 goes through the BUTLER network 12, generates another group of signals whose phases are b1:b2:b3:b4:b5 at five output ports and, after being transmitted by the radiating elements of the antenna array 11, splits and generates a downward beam (D_beam) bearing the second path of signals on the vertical plane, as shown by the down-tilting ellipse on the left side of the radiating elements in FIG. 1A, thereby generating dual beams on the vertical plane of the antenna array 11.

The phases of the five ports corresponding to the D_beam are, for example, b1:b2:b3:b4:b5=0:−90:−180(180):−270:0(−360), as shown in FIG. 1B.

In the antenna array 11, the power amplitude ratio of the radiating elements may be adjusted depending as required, for example, 0.7/0.7/1/1/1/1/1/1/0.7/0.7.

Embodiment 2

Figure 2:
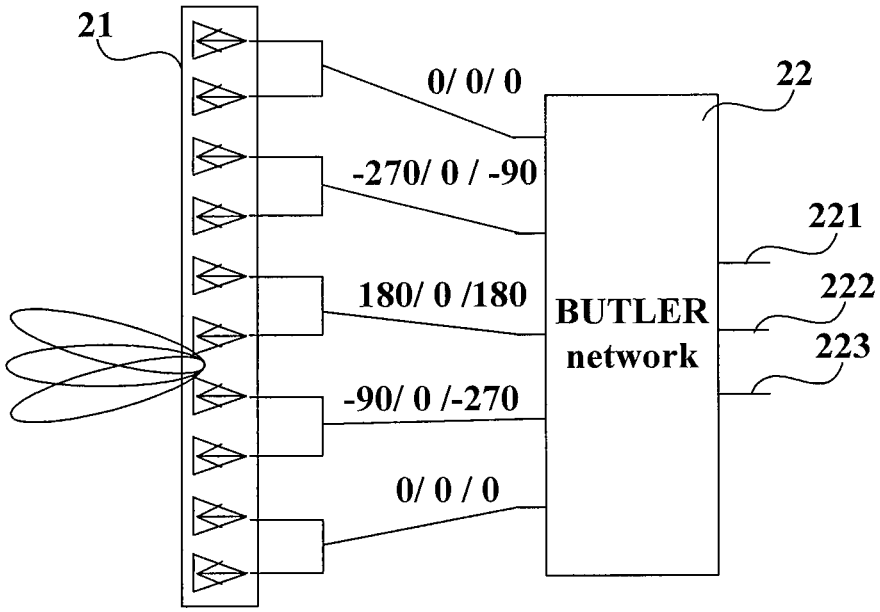
FIG. 2 is a schematic diagram of an antenna according to Embodiment 2 of the present invention.

As shown in FIG. 2, an antenna includes an antenna array 21 and a BUTLER network 22. The antenna array 21 includes 10 radiating elements arranged on a vertical plane. The BUTLER network 22 is a 3-in-5-out matrix network, that is, there are three input ports: a first input port 221, a second input port 222, and a third beam input port 223. Each output port of the BUTLER network 22 is connected to two radiating elements in the antenna array 21 by using a power divider. The 10 radiating elements connected to the BUTLER network 22 in the antenna array 21 are arranged on a vertical plane.

A first path of signals which are input through the first input port 221 goes through the antenna array 21, generates a group of signals whose phase distribution combination is a1:a2:a3:a4:a5 at five output ports and, after being transmitted by the 10 radiating elements arranged on a vertical plane of the antenna array 21, generates an upward beam (U_beam) bearing the first path of signals, as shown by the up-tilting ellipse on the left side of the radiating elements in FIG. 2.

The phases of the five ports corresponding to the U_beam are, for example, a1:a2:a3:a4:a5=0:−270:180:−90:0.

A second path of signals which are input through the second input port 222 goes through the antenna array 21, generates another group of signals whose phase distribution combination is b1:b2:b3:b4:b5 at five output ports and, after being transmitted by the 10 radiating elements arranged on a vertical plane of the antenna array 21, generates a middle beam (M_beam) bearing the second path of signals, as shown by the horizontal ellipse on the left side of the radiating elements in FIG. 2.

Persons skilled in the art should understand that the ellipses are schematic beams rather than actual shapes of the beams. The directions are distinguished by the positions they are placed.

The phases of the five ports corresponding to the M_beam are, for example, b1:b2:b3:b4:b5=0:0:0:0:0.

A third path of signals which are input through the third beam input port 223 goes through the antenna array 21, generates another group of signals whose phase distribution combination are c1:c2:c3:c4:c5 at five output ports and, after being transmitted by the 10 radiating elements arranged on a vertical plane of the antenna array 21, generates a downward beam (D_beam) bearing the third path of signals, as shown by the down-tilting ellipse on the left side of the radiating elements in FIG. 2, thereby generating three beams on the vertical plane of the antenna array 21.

The phases of the five ports corresponding to the D_beam are, for example, c1:c2:c3:c4:c5=0:−90:−180(180):−270:0(−360).

Similar to that in embodiment 1, the power amplitude ratio of the radiating elements may be adjusted as required, for example, 0.7/0.7/1/1/1/1/1/1/0.7/0.7.

Embodiment 3

Figure 3A:
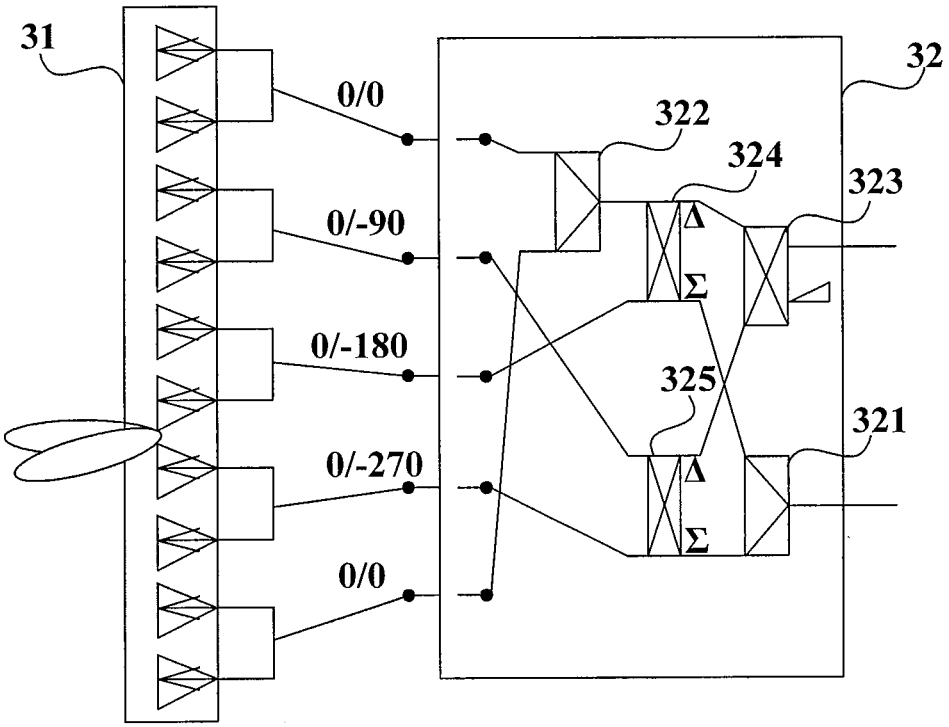
FIG. 3A is a schematic diagram of an antenna according to Embodiment 3 of the present invention.
Figure 3B:
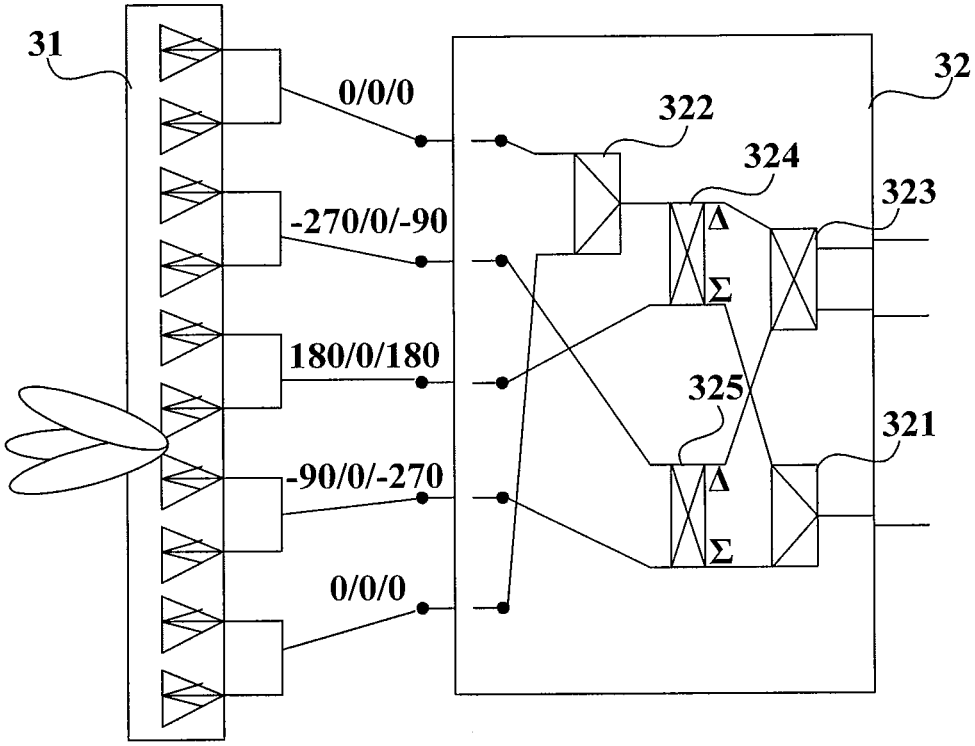
FIG. 3B is a schematic diagram of another antenna according to Embodiment 3 of the present invention.

As shown in FIGS. 3A and 3B, an antenna includes an antenna array 31 and a BUTLER network 32. The antenna array 31 includes 10 radiating elements arranged on a vertical plane. The BUTLER network 32 includes a first power divider 321, a second power divider 322, a 90-degree hybrid coupler 323, a first 180-degree hybrid coupler 324, and a second 180-degree hybrid coupler 325.

An input port of the first power divider 321 and an input port of the 90-degree hybrid coupler 323 are respectively connected to an input port of the BUTLER network 32. As shown in FIG. 3A, a first input port of the 90-degree hybrid coupler 323 is connected to a first input port of the BUTLER network 32, a second input port of the 90-degree hybrid coupler 323 is zero loaded, the input port of the first power divider 321 is connected to a second input port of the BUTLER network 32. That is to say, the BUTLER network 32 has two input ports.

As shown in FIG. 3B, the first input port of the 90-degree hybrid coupler 323 is connected to the first input port of the BUTLER network 32, the second input port of the 90-degree hybrid coupler 323 is connected to a second input port of the BUTLER network 32, the input port of the first power divider 321 is connected to a third input port of the BUTLER network 32. That is to say, the BUTLER network 32 has three input ports.

An output port of the first power divider 321 is connected to a Σ input port of the first 180-degree hybrid coupler 324, and another output port is connected to a Σ input port of the second 180-degree hybrid coupler 325.

An output port of the 90-degree hybrid coupler 323 is connected to a Δ input port of the first 180-degree hybrid coupler 324, and another output port is connected to a Δ input port of the second 180-degree hybrid coupler 325.

An output port of the first 180-degree hybrid coupler 324 is connected to an input port of the second power divider 322, and another output port is connected to an output port of the BUTLER network 32.

Two output ports of the second 180-degree hybrid coupler 325 are respectively connected to an output port of the BUTLER network 32.

Two output ports of the second power divider 322 are respectively connected to an output port of the BUTLER network 32.

It is obvious that, the BUTLER network 32 in FIG. 3A is a 2-in-5-out matrix network, the BUTLER network 32 in FIG. 3B is a 3-in-5-out matrix network, and each output port of the BUTLER network 32 is connected to two radiating elements in the antenna array 31 by using the power divider. The 10 radiating elements connected to the BUTLER network 32 in the antenna array 31 are arranged on a vertical plane.

For the detailed process of generating an upward beam and a downward beam by the antenna in FIG. 3A, reference may be made to the description of the Embodiment 1; for the detailed process of generating an upward beam, a middle beam, and a downward beam by the antenna in FIG. 3B, reference may be made to the description of the Embodiment 2.

Embodiment 4

Figure 4:
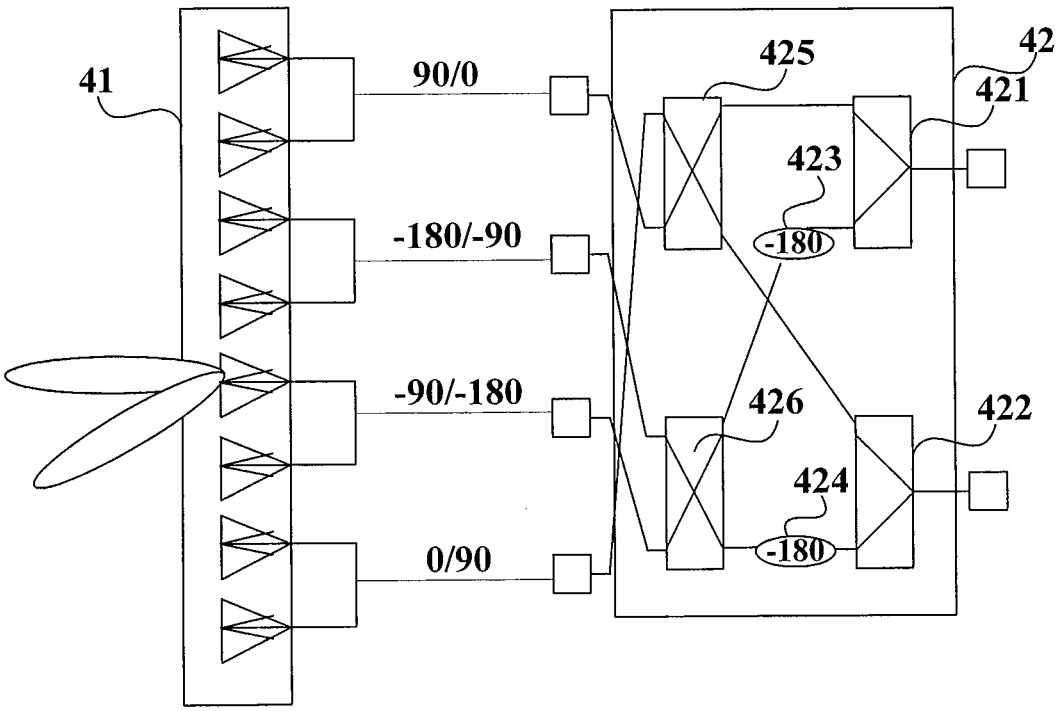
FIG. 4 is a schematic diagram of an antenna according to Embodiment 4 of the present invention.

As shown in FIG. 4, an antenna includes an antenna array 41 and a BUTLER network 42. The antenna array 41 includes 8 radiating elements arranged on a vertical plane. The BUTLER network 42 is a 2-in-4-out matrix network, and includes a third power divider 421, a fourth power divider 422, a first inverter 423, a second inverter 424, a first 90-degree hybrid coupler 425, and a second 90-degree hybrid coupler 426.

Input ports of the third power divider 421 and the fourth power divider 422 are respectively connected to an input port of the BUTLER network 42. As shown in FIG. 4, the input port of the third power divider 421 is connected to a first input port of the BUTLER network 42, and the input port of the fourth power divider 422 is connected to a second input port of the BUTLER network 42.

An output port of the third power divider 421 is connected to a first input port of the first 90-degree hybrid coupler 425, and another output port is connected to an input port of the first inverter 423.

An output port of the fourth power divider 422 is connected to a second input port of the first 90-degree hybrid coupler 425, and another output port is connected to an input port of the second inverter 424.

An output port of the first inverter 423 is connected to a first input port of the second 90-degree hybrid coupler 426.

An output port of the second inverter 424 is connected to a second input port of the second 90-degree hybrid coupler 426.

Two output ports of the first 90-degree hybrid coupler 425 are respectively connected to an output port of the BUTLER network 42; two output ports of the second 90-degree hybrid coupler 426 are respectively connected to an output port of the BUTLER network 42.

A first path of signals which are input through the first input port of the BUTLER network 42 goes through the BUTLER network 42, generates a group of signals whose phase distribution combination is 90:−180:−90:0 at four output ports and, after being transmitted by the radiating elements of the antenna array 41, generates an upward beam bearing the first path of signals.

A second path of signals which are input through the second input port of the BUTLER network 42 goes through the BUTLER network 42, generates another group of signals whose phase distribution combination is 0:−90:−180:90 at four output ports and, after being transmitted by the radiating elements of the antenna array 41, generates a downward beam bearing the second path of signals, thereby generating dual beams on the vertical plane of the antenna.

Embodiment 5

Figure 5:
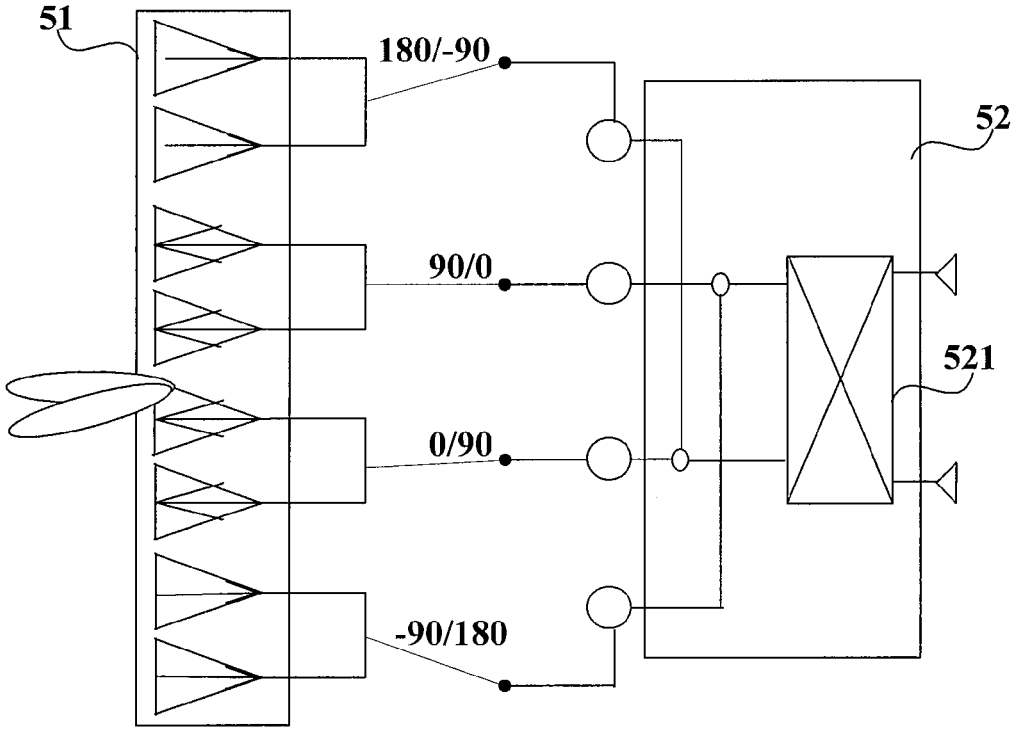
FIG. 5 is a schematic diagram of an antenna according to Embodiment 5 of the present invention.

As shown in FIG. 5, an antenna includes an antenna array 51 and a BUTLER network 52. The antenna array 51 includes 8 radiating elements arranged on a vertical plane. The BUTLER network 52 is a 2-in-4-out matrix network and includes a 90-degree hybrid coupler 521, where two input ports of the 90-degree hybrid coupler 521 are respectively connected to an input port of the BUTLER network 52, and two output ports are connected to two output ports of the BUTLER network 52.

A first path of signals which are input through a first input port of the BUTLER network 52 goes through the BUTLER network 52, generates a group of signals whose phase distribution combination is 90:−180:−90:0 at four output ports and, after being transmitted by the radiating elements of the antenna array 51, generates an upward beam bearing the first path of signals, as shown by the horizontal ellipse on the left side of the radiating elements in FIG. 5.

A second path of signals which are input through a second input port of the BUTLER network 52 goes through the BUTLER network 52, generates a group of signals whose phase distribution combination is 0:−90:−180:90 at four output ports and, after being transmitted by the radiating elements of the antenna array 51, generates a downward beam bearing the second path of signals, as shown by the downtitling ellipse on the left side of the radiating elements in FIG. 5, thereby generating dual beams on the vertical plane of the antenna.

In this embodiment, the BUTLER network 52 uses a 90-degree hybrid coupler to implement the splitting function, thereby meeting the phase requirements respectively.

Assume original phases after going through the BUTLER network 52 are as follows:

First beam=0:90:0:90 second beam=90:0:90:0

The final implemented phases after the physical reversion by the radiating elements of the antenna array 51 are as follows:

First beam=180:90:0:−90 second beam=−90:0:90:180

Embodiment 6

Figure 6:
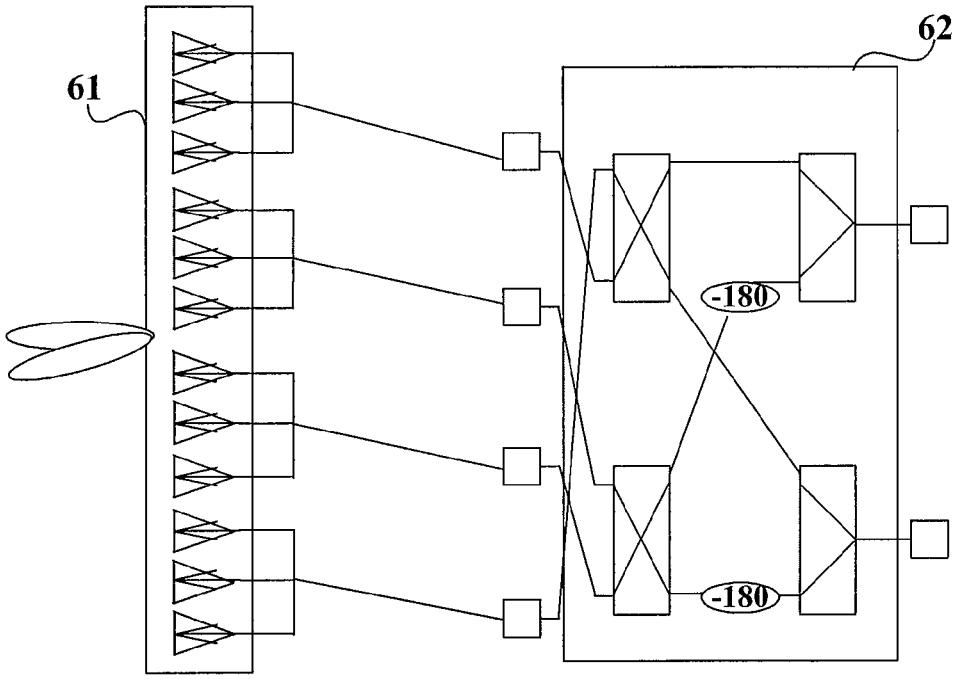
FIG. 6 is a schematic diagram of an antenna according to Embodiment 6 of the present invention.

As shown in FIG. 6, an antenna includes an antenna array 61 and a BUTLER network 62. The antenna array 61 includes 12 radiating elements arranged on a vertical plane. The BUTLER network 62 is a 2-in-4-out matrix network, where output ports thereof are respectively connected to 3 radiating elements. The internal structure of the BUTLER network 62 may be the same as that of the BUTLER network provided in Embodiment 4 or Embodiment 5, which is described in detail foregoing and is not repeated here.

Embodiment 7

Figure 7:
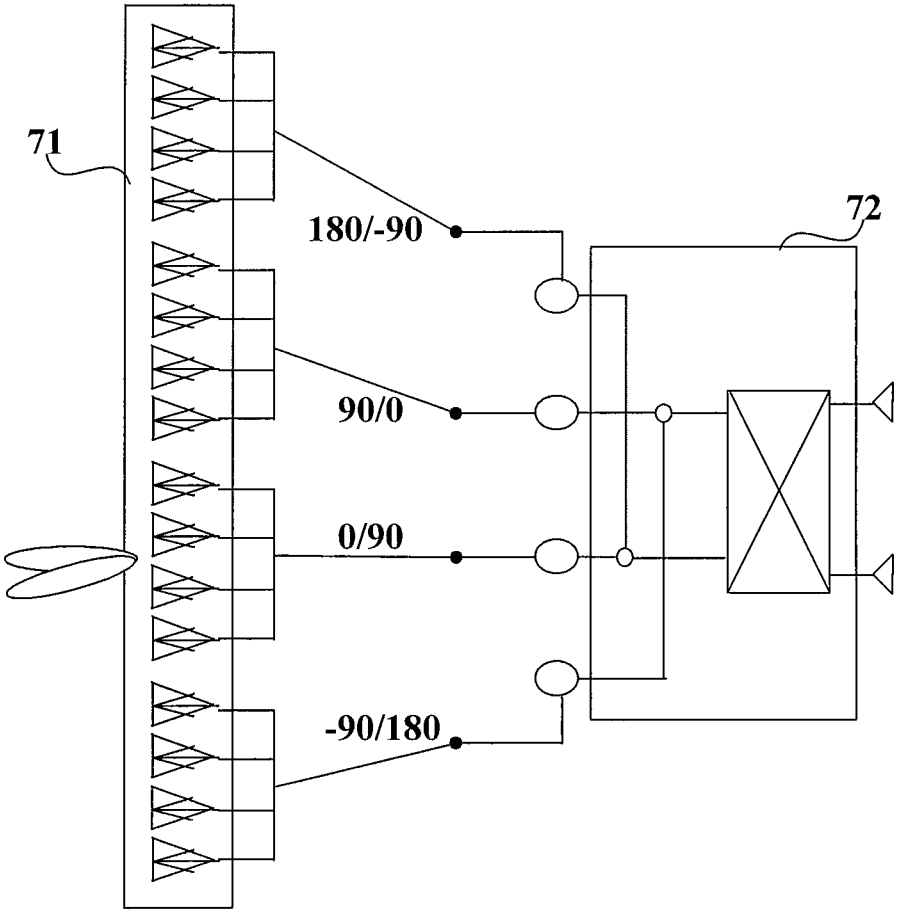
FIG. 7 is a schematic diagram of an antenna according to Embodiment 7 of the present invention.

As shown in FIG. 7, an antenna includes an antenna array 71 and a BUTLER network 72. The antenna array 71 includes 16 radiating elements arranged on a vertical plane. The BUTLER network 72 is a 2-in-4-out matrix network, where output ports thereof are respectively connected to 4 radiating elements. The internal structure of the BUTLER network 72 may be the same as that of the BUTLER network provided in Embodiment 4 or Embodiment 5, which is described in detail foregoing and is not repeated here.

It should be noted that the number of radiating elements which are connected to each output port of the BUTLER network is not limited to the cases described in the foregoing embodiments. The number of radiating elements may be different depending on the actual requirements.

Embodiment 8

In this embodiment, a phase shifter is added on the basis of the embodiment in FIG. 3A.

Figure 8:
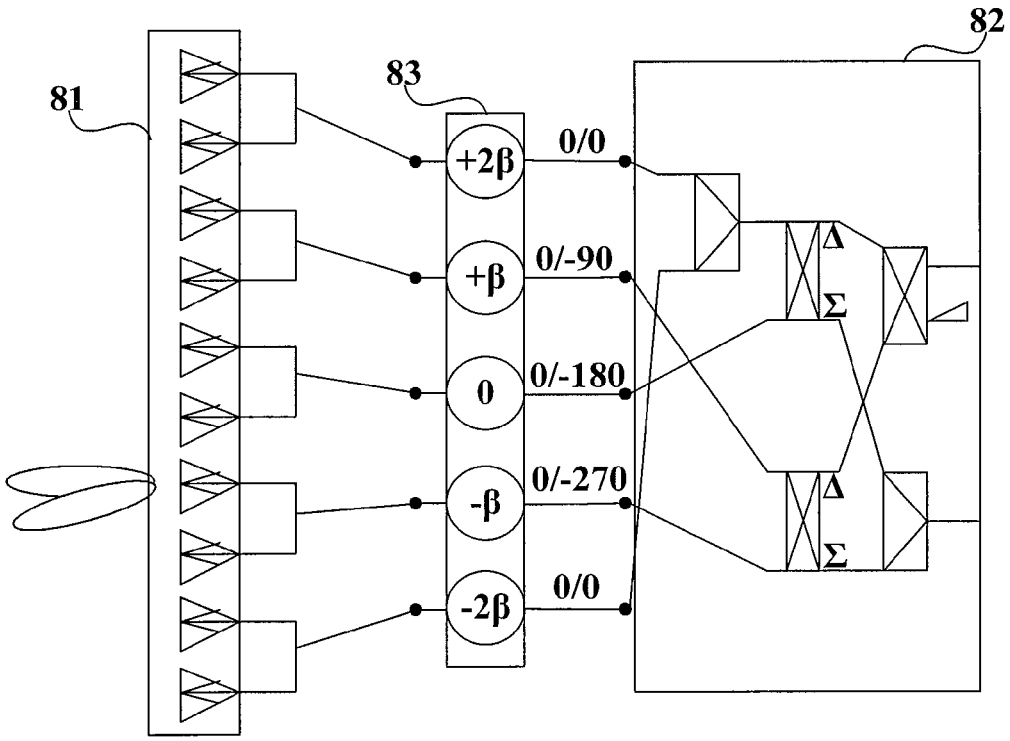
FIG. 8 is a schematic diagram of an antenna according to Embodiment 8 of the present invention.

Specifically, as shown in FIG. 8, a phase shifter 83 is added between a BUTLER network 82 and an antenna array 81. The phase shifter 83 may be an N-in-N-out phase shifter. The phase shifter 83 in FIG. 8 is a 5-in-5-out phase shifter.

Five input ports of the phase shifter 83 are respectively one-to-one corresponding to and connected to five output ports of the BUTLER network 82. Five output ports of the phase shifter 83 are connected to radiating elements of the antenna array 81, where each output port may be connected to multiple radiating elements. In this embodiment, each output port of the phase shifter 83 is connected to two radiating elements.

In FIG. 8, phases at each port of the phase shifter 83 may change with the ratio of $+2\Phi:\Phi:0:-\Phi:2\Phi$, or with other phase ratios.

In this embodiment, the antenna achieves the effect of simultaneous down-tilting change of two beams of the antenna by using the phase shifter.

Embodiment 9

In this embodiment, a phase shifter is added on the basis of the embodiment in FIG. 5.

Figure 9:
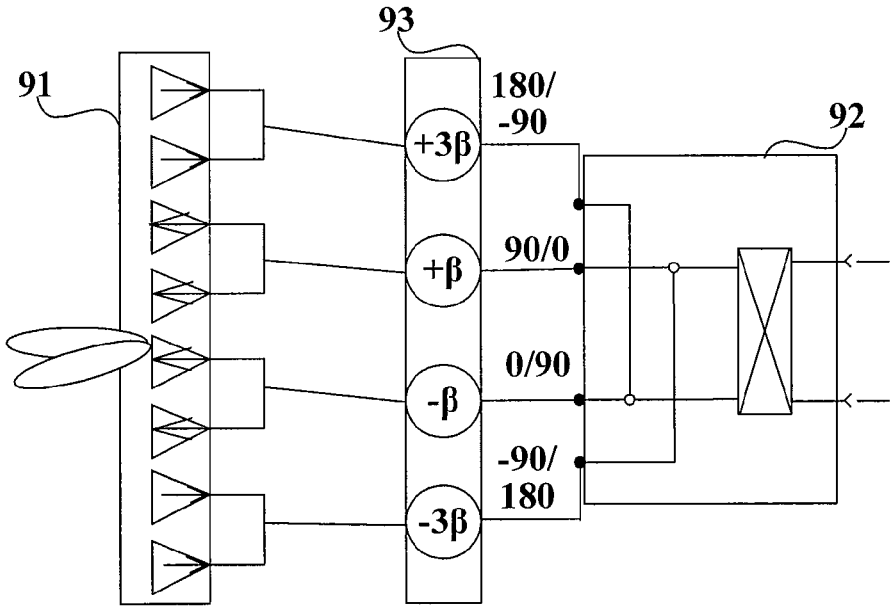
FIG. 9 is a schematic diagram of an antenna according to Embodiment 9 of the present invention.

Specifically, as shown in FIG. 9, an antenna includes an antenna array 91, a BUTLER network 92, and a phase shifter 93.

The phase shifter 93 may be an N-in-N-out phase shifter. The phase shifter 93 in FIG. 9 is a 4-in-4-out phase shifter.

Four input ports of the phase shifter 93 are respectively one-to-one corresponding to and connected to four output ports of the BUTLER network 92. Four output ports of the phase shifter 93 are connected to radiating elements of the antenna array 91, where each output port may be connected to multiple radiating elements. Here, each output port of the phase shifter 93 is connected to two radiating elements.

In FIG. 9, phases at each port of the phase shifter 93 may change with the ratio of $+3\Phi:\Phi:-\Phi:3\Phi$, or with other phase ratios.

In this embodiment, the antenna also achieves the effect of simultaneous down-tilting change of two beams of the antenna by using the phase shifter.

Embodiment 10

Figure 10A:
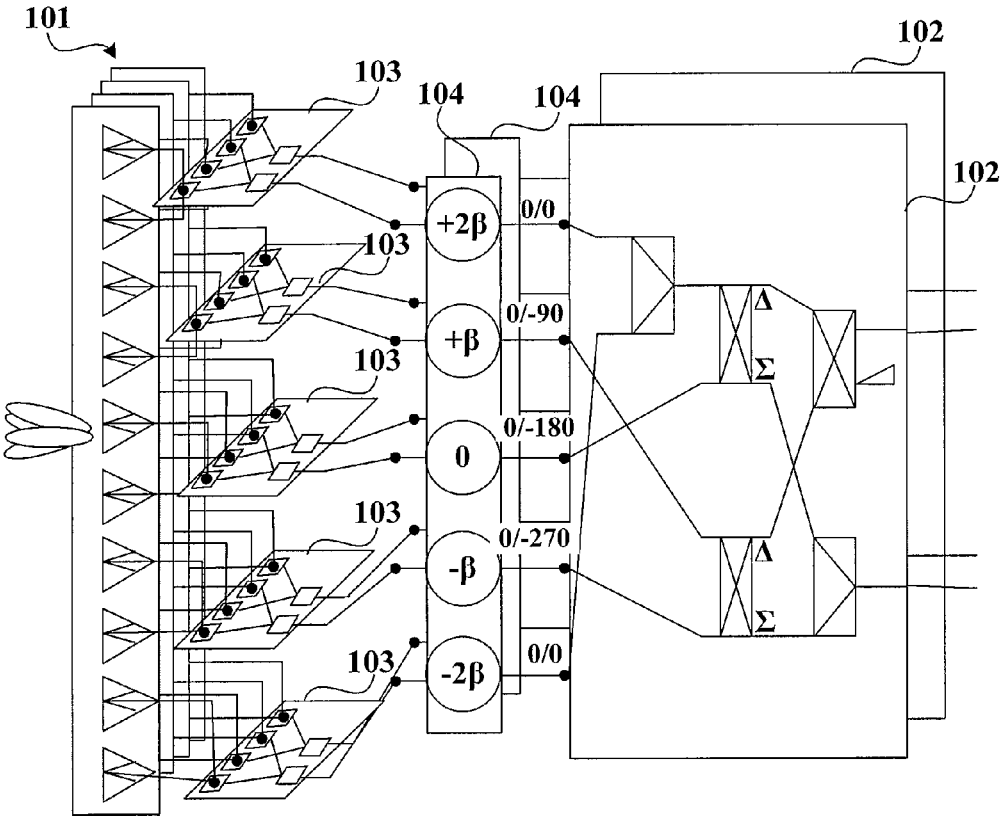
FIG. 10A is a schematic diagram of an antenna according to Embodiment 10 of the present invention.

As shown in FIG. 10A, an antenna includes an antenna array 101, first BUTLER networks 102, second BUTLER networks 103, and phase shifters 104.

The antenna 101 is an array of 4×10 radiating elements. The first BUTLER network 102 and the phase shifter 104 are the same as those in the embodiment shown in FIG. 8. There are two first BUTLER networks 102, namely, a left first BUTLER network 102 and a right first BUTLER network 102, which are matrix networks on two vertical planes. Output ports of the first BUTLER networks 102 are arranged on five different horizontal planes. Correspondingly, there are two phase shifters 104, namely, a left phase shifter 104 and a right phase shifter 104, which are 5-in-5-out phase shifters and are respectively connected to a first BUTLER network 102.

There are five second BUTLER networks 103, which are matrix networks on five different horizontal planes and are connected to output ports on different horizontal planes of the left phase shifter 104 and right phase shifter 104.

Left input ports of the five second BUTLER networks 103 are connected to the five output ports of the left first BUTLER network 102 through the output ports of the left phase shifter 104, which implements upward beams and downward beams of a left first beam and a left second beam on the horizontal plane.

Right input ports of the five second BUTLER networks 103 are connected to the five output ports of the right first BUTLER network 102 through the output ports of the right phase shifter 104, which implements upward beams and downward beams of a right first beam and a right second beam on the horizontal plane.

Figure 10B:
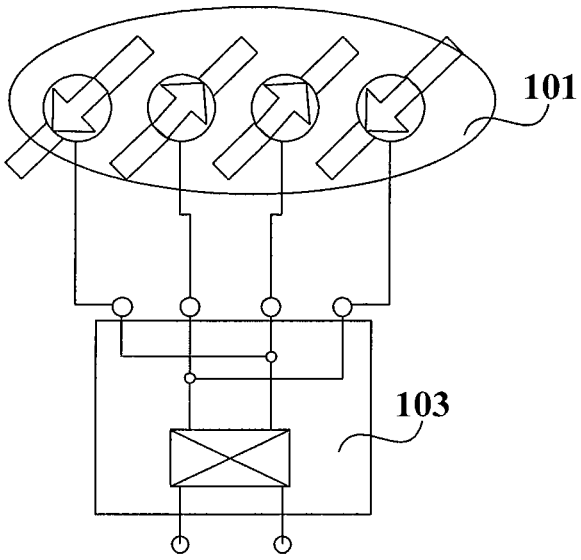
FIG. 10B is schematic diagram illustrating connection between a second BUTLER network and radiating elements in the antenna according to Embodiment 10 of the present invention.

Each output port of each second BUTLER network 103 is connected to two radiating elements on one vertical plane. As shown in FIG. 10B, the output ports of the second BUTLER network 103 on each horizontal plane are connected to an array of 4×2 radiating elements of the antenna array 101. The internal structure of the second BUTLER networks 103 may be the same as the internal structure of any 2-in-4-out matrix network provided in the foregoing embodiments.

In this embodiment, the antenna implements the function of horizontal splitting in a vertical splitting antenna by using first and second BUTLER networks, and by setting phase shifters between the horizontal matrix networks and vertical matrix networks, implements the function of down-tilting beams.

Embodiment 11

This embodiment is basically the same as the Embodiment 10, but is different in that a first BUTLER network has four output ports, and correspondingly, there are four second BUTLER networks and an antenna array is an array of 4×12 radiating elements.

Figure 11:
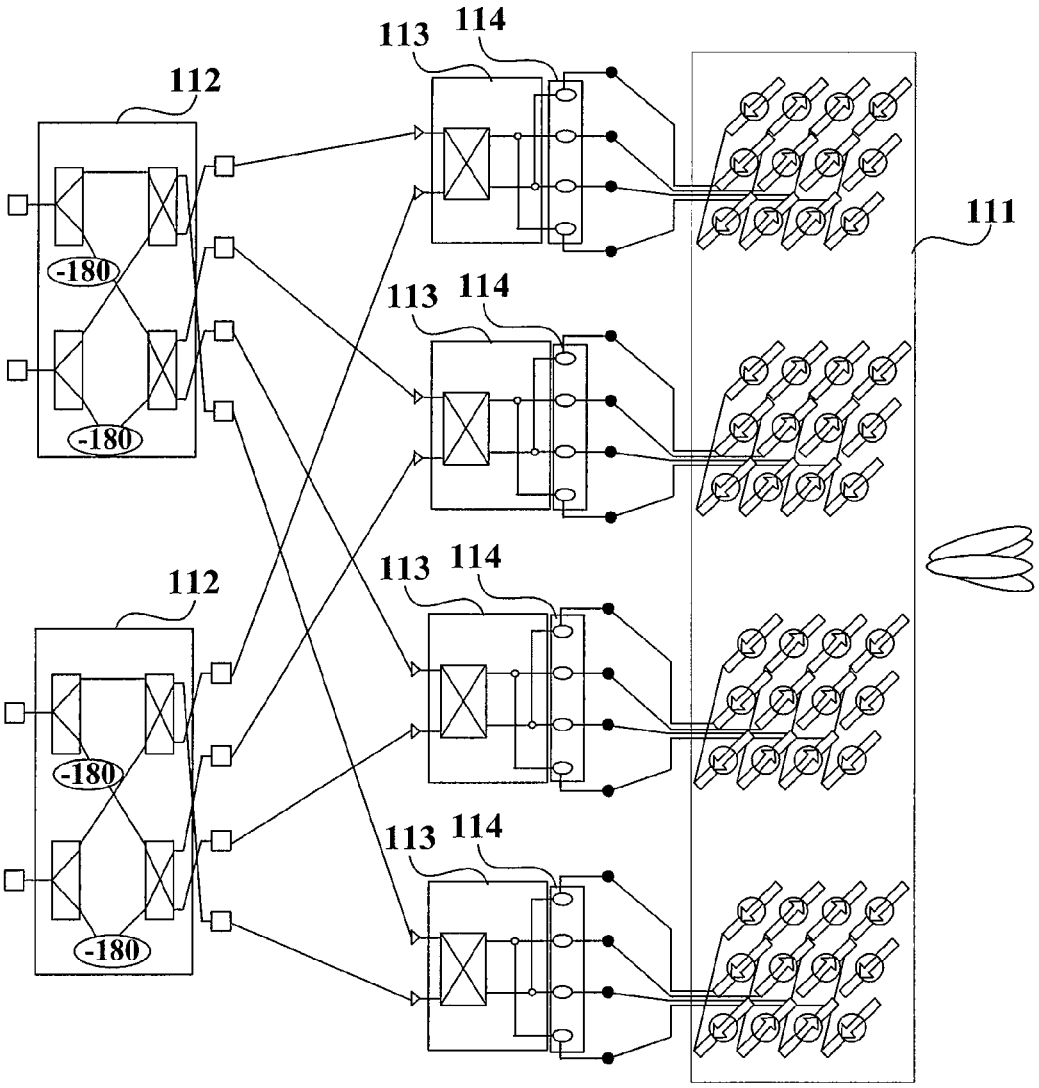
FIG. 11 is a schematic diagram of an antenna according to Embodiment 11 of the present invention.

As shown in FIG. 11, an antenna includes an antenna array 111, first BUTLER networks 112, second BUTLER networks 113, and phase shifters 114.

Each output port of the second BUTLER networks 113 is connected to three radiating elements on one vertical plane.

The first BUTLER networks 112 are the same as the BUTLER network in the embodiment shown in FIG. 4.

This embodiment also implements horizontal and vertical splitting, and by setting phase shifters between the horizontal matrix networks and vertical matrix networks, implements the function of down-tilting beams.

Embodiment 12

This embodiment is basically the same as the embodiment shown in FIG. 8, but is different in that radiating elements are orthogonal dual-polarized dipole elements and there are two BUTLER networks.

Figure 12:
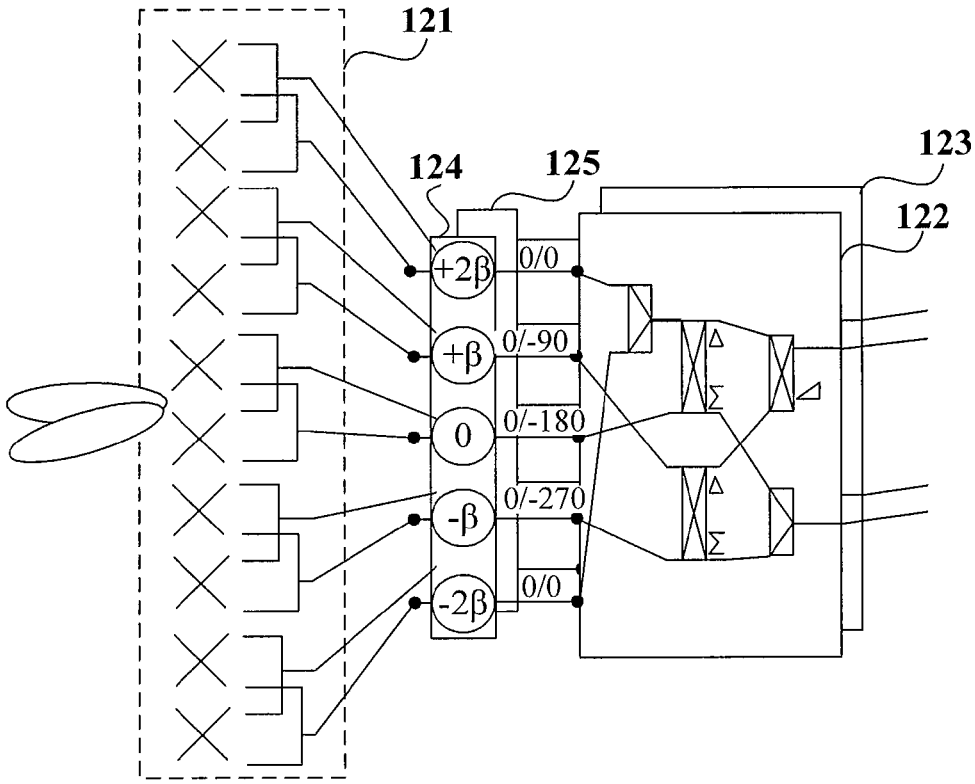
FIG. 12 is a schematic diagram of an antenna according to Embodiment 12 of the present invention.

Specifically, as shown in FIG. 12, an antenna includes an antenna array 121, a positive 45-degree polarized BUTLER network 122, a negative 45-degree polarized BUTLER network 123, a positive 45-degree polarized phase shifter 124, and a negative 45-degree polarized phase shifter 125.

The antenna array 121 includes 10 orthogonal dual-polarized dipole elements arranged on a vertical plane.

Embodiment 13

This embodiment adds a filter on the basis of the foregoing embodiments for distinguishing signals on different frequency bands.

Figure 13:
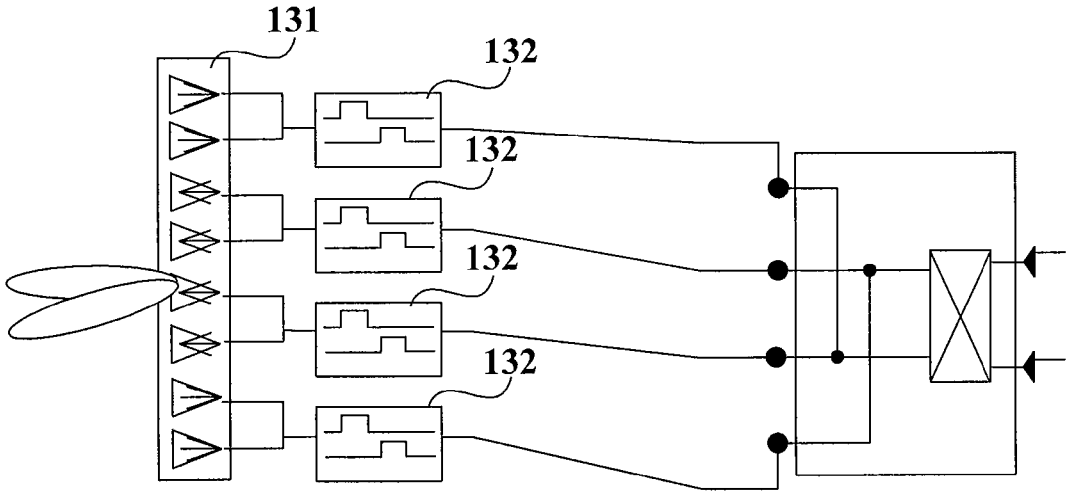
FIG. 13 is a schematic diagram of an antenna according to Embodiment 13 of the present invention.

Specifically as shown in FIG. 13, the right side of radiating elements of an antenna array 131 is the cable port, or specifically input ports of power dividers may be connected to filters 132. Input ports of the filters 132 may be connected to output ports of phase shifters, output ports of first BUTLER networks, or output ports of second BUTLER networks. In other words, filters may be added between radiating elements and matrix networks, and between radiating elements and phases, thereby implementing splitting on vertical planes for frequency division antennas. Here the input ports of the filters 132 are connected to output ports of BUTLER networks.

The antennas provided in the foregoing embodiments is capable of implementing not only splitting on vertical planes, but also splitting on vertical planes and horizontal planes at the same time, and also the down-tilting function in splitting on vertical planes.

Embodiment 14

Figure 14:
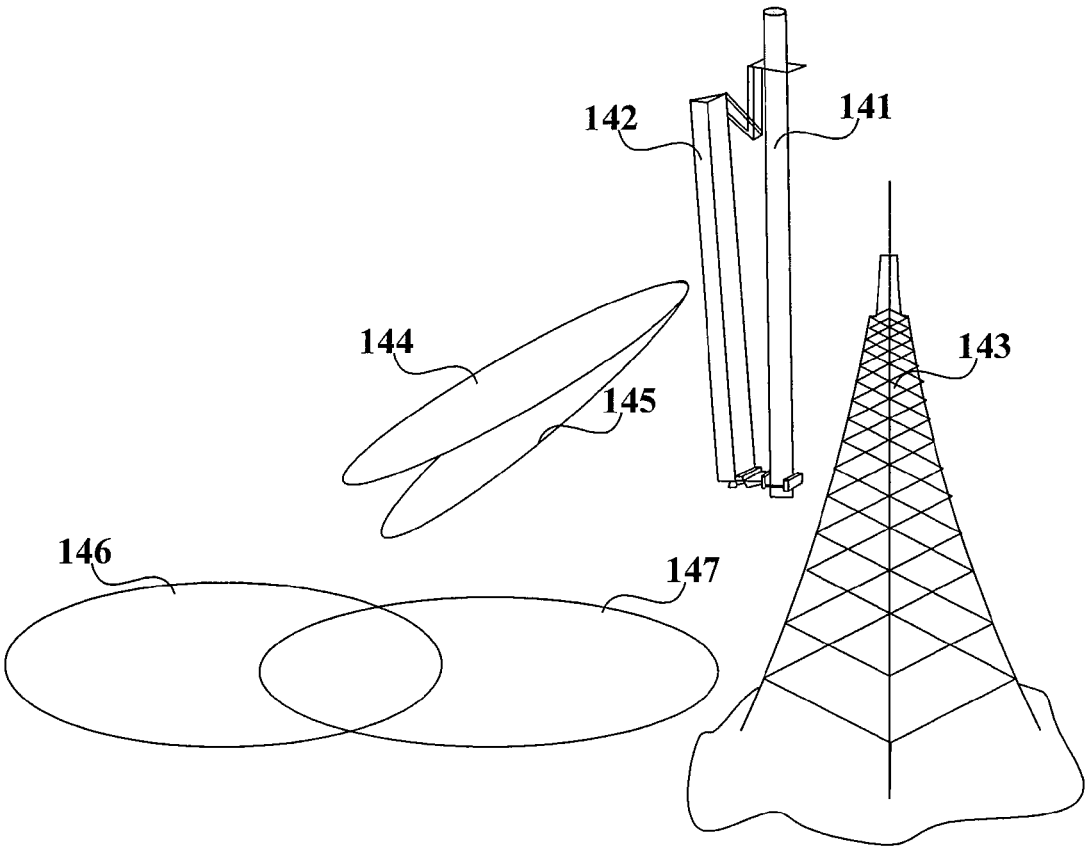
FIG. 14 is schematic diagram of partial structure and signal coverage of a base station according to Embodiment 14 of the present invention.

As shown in FIG. 14, a base station includes a pole 141 and an antenna 142, where the antenna 142 is fixed on the pole 141, and the pole 141 is fixed on a tower 143 to ensure as large coverage as possible for the antenna 142. The antenna 142 contains any one of the antennas provided in Embodiment 1 to Embodiment 13. When the antenna contained by the antenna 142 merely implements vertical splitting, the generated beams are shown in FIG. 14, which are a first beam 144 and a second beam 145 on a vertical plane, and respectively cover a first area 146 and a second area 147. Persons skilled in the art should understand that, besides the foregoing antenna and pole, the base station also includes basic functional units, such as base band processing, which are not key points of the present invention and are not described herein.

The base station provided by the embodiment of the present invention, by using the antennas capable of implementing splitting on vertical planes, is capable of implementing splitting of signals transmitted by the base station on vertical planes; further, when the antenna capable of implementing splitting on vertical and horizontal planes is used, the base station is capable implement splitting on vertical and horizontal planes at the same time, and also capable of implementing the down-tilting function in splitting on vertical planes; further, by using antennas with phase shifters, the base station is further capable of implementing the down-tilting function in splitting on vertical planes.

Persons of ordinary skill in the art should understand that all or a part of the steps of the method according to the embodiments may be implemented by a program instructing relevant hardware. The program may be stored in a computer readable storage medium. When the program is run, the steps of the method according to the embodiments are performed. The storage medium includes various mediums capable of storing the program code such as a ROM, a RAM, a magnetic disk, or a CD-ROM.

Finally, it should be noted that the foregoing embodiments are merely provided for describing the technical solution of the present invention, but not intended to limit the present invention. It should be understood by persons of ordinary skill in the art that although the present invention has been described in detail with reference to the embodiments, modifications may be made to the technical solutions described in the embodiments, or equivalent replacements may be made to some technical features in the technical solutions; however, such modification or replacement does not make the essence of corresponding technical solutions exceed the scope of the technical solutions according to the embodiments of the present invention.

The invention claimed is:

1. An antenna, comprising an antenna array and a first BUTLER network, wherein the antenna array comprises multiple radiating elements, each of the multiple radiating elements is vertically arranged along a vertical column;

the first BUTLER network has n input ports and m output ports, wherein m and n are natural numbers, n is greater than or equal to 2, m is equal to 5, and m is greater than n;

each of the m output ports is respectively connected to at least one of the vertically arranged multiple radiating elements of the antenna array along the vertical column;

the first BUTLER network comprises a first sower divider a second ower divider a 90-degree hybrid coupler, a first 180-degree hybrid coupler, and a second 180-degree hybrid coupler; wherein an input port of the first power divider is connected to one input port of the first BUTLER network;

one output port of the first power divider is connected to a Σ input port of the first 180-degree hybrid coupler, and the other output port of the first power divider is connected to a Σ input port of the second 180-degree hybrid coupler;

one output port of the 90-degree hybrid coupler is connected to a Δ input port of the first 180-degree hybrid coupler, and the other output port of the 90-degree hybrid coupler is connected to a Δ input port of the second 180-degree hybrid coupler;

one output port of the first 180-degree hybrid coupler is connected to an input port of the second power divider, and the other output port of the first 180-degree hybrid coupler is connected to one of the output ports of the first Butler network;

two output ports of the second 180-degree hybrid coupler are connected to two other output ports of the first Butler network, respectively;

two output ports of the second power divider are connected to another two output ports of the first Butler network respectively; wherein one of the following conditions is met:

if n is equal to 2, an input port of the 90-degree hybrid coupler is connected to another input port of the first BUTLER network; and if n is equal to 3, both input ports of the 90-degree hybrid coupler are respectively connected to two other input ports of the first BUTLER network; and the first BUTLER network is configured to:

receive n sequences of signals through the n input ports and perform phase adjustment to the n sequences of signals, output signals of n groups of phase distribution combination through the m output ports, each group of phase distribution combination includes m phases, wherein each output port is configured to respectively output signals of one phase in each group of phase distribution combination, each of the multiple radiating elements connected to the m output ports is configured to radiate n beams, and each of the n beams are vertically distributed at different angles along the vertical column.

2. An antenna, comprising an antenna array and a first BUTLER network, wherein the antenna array comprises multiple radiating elements, each of the multiple radiating elements is vertically arranged along a vertical column;

the first BUTLER network has n input ports and m output ports, wherein m and n are natural numbers, n is greater than or equal to 2, m is greater than or equal to 3, and m is greater than n;

each of the m output ports is respectively connected to at least one of the vertically arranged multiple radiating elements of the antenna array along the vertical column; and the first BUTLER network at least comprises a first power divider, a second power divider, a 90-degree hybrid coupler, a first 180-degree hybrid coupler, and a second 180-degree hybrid coupler; wherein an input port of the first power divider is connected to one input port of the first BUTLER network;

one output port of the first power divider is connected to a Σ input port of the first 180-degree hybrid coupler, and the other output port of the first power divider is connected to a Σ input port of the second 180-degree hybrid coupler;

one output port of the 90-degree hybrid coupler is connected to a Δ input port of the first 180-degree hybrid coupler, and the other output port of the 90-degree hybrid coupler is connected to a Δ input port of the second 180-degree hybrid coupler;

one output port of the first 180-degree hybrid coupler is connected to an input port of the second power divider, and the other output port of the first 180-degree hybrid coupler is connected to one of the output ports of the first Butler network;

two output ports of the second 180-degree hybrid coupler are connected to two output ports of the first Butler network, respectively;

two output ports of the second power divider are connected to two other output ports of the first Butler network of the first Butler network respectively;

at least one input port of the 90-degree hybrid coupler is connected to at least one other input port of the first BUTLER network.

* * * * *

UNITED STATES PATENT AND TRADEMARK OFFICE

CERTIFICATE OF CORRECTION

PATENT NO. : 8,736,493 B2
APPLICATION NO. : 13/619301
DATED : May 27, 2014
INVENTOR(S) : Ming Ai et al.

It is certified that error appears in the above-identified patent and that said Letters Patent is hereby corrected as shown below:

In the Claims

In column 12, claim 1, line 25, after "comprises a first" replace "sower" with --power--.

In column 12, claim 1, line 26, after "a second" replace "ower" with --power--.

Signed and Sealed this
Twenty-third Day of September, 2014

Michelle K. Lee

Michelle K. Lee
*Deputy Director of the United States Patent and Trademark Office*